US008640581B2

(12) United States Patent
Weissenberger

(10) Patent No.: US 8,640,581 B2
(45) Date of Patent: Feb. 4, 2014

(54) CUTTING MACHINE FOR CUTTING MATS

(75) Inventor: Andreas Weissenberger, Rebstein (CH)

(73) Assignee: Weissenberger AG (CH)

( * ) Notice: Subject to any disclaimer, the term of this patent is extended or adjusted under 35 U.S.C. 154(b) by 286 days.

(21) Appl. No.: 13/130,762

(22) PCT Filed: Sep. 7, 2009

(86) PCT No.: PCT/CH2009/000298
§ 371 (c)(1),
(2), (4) Date: May 24, 2011

(87) PCT Pub. No.: WO2010/066054
PCT Pub. Date: Jun. 17, 2010

(65) Prior Publication Data

US 2011/0226100 A1 Sep. 22, 2011

(30) Foreign Application Priority Data

Dec. 10, 2008 (CH) ..... 1939/08

(51) Int. Cl.
*B26D 1/00* (2006.01)
*B26D 5/08* (2006.01)
*B27B 27/06* (2006.01)

(52) U.S. Cl.
USPC ..... 83/34; 83/581; 83/471.3; 83/940

(58) Field of Classification Search
USPC ..... 83/13, 34, 39, 232, 399, 400, 743, 83/508.1, 508.2, 563, 564, 581, 698.11, 83/940, 455, 782, 471.3; 30/155–57
See application file for complete search history.

(56) References Cited

U.S. PATENT DOCUMENTS

| | | | | |
|---|---|---|---|---|
| 3,779,119 | A * | 12/1973 | Broides | 83/581 |
| 3,967,519 | A * | 7/1976 | Esterly | 83/455 |
| 4,422,359 | A * | 12/1983 | Leboeuf | 83/546 |
| 4,440,055 | A * | 4/1984 | Gelfand | 83/529 |
| 4,871,156 | A * | 10/1989 | Kozyrski et al. | 269/303 |
| 5,855,155 | A * | 1/1999 | Weissenberger et al. | 83/76.9 |
| 5,931,073 | A * | 8/1999 | Hoyer-Ellefsen | 83/471.3 |
| 6,138,546 | A * | 10/2000 | Hursey | 83/875 |
| 2005/0132865 | A1 * | 6/2005 | Wridge et al. | 83/881 |
| 2006/0037694 | A1 * | 2/2006 | Yamamoto et al. | 156/250 |
| 2006/0283293 | A1 * | 12/2006 | West | 83/13 |

FOREIGN PATENT DOCUMENTS

| | | |
|---|---|---|
| GB | 2274801 | 8/1994 |
| WO | WO 2007/083455 | 7/2007 |
| WO | WO 2008/004253 | 1/2008 |

* cited by examiner

*Primary Examiner* — Sean Michalski
*Assistant Examiner* — Jonathan G Riley
(74) *Attorney, Agent, or Firm* — Gallbreath Law Offices, P.C.; John A. Galbreath

(57) ABSTRACT

The invention relates to a cutting machine, in particular for cutting mats to size by means of a blade (21) arranged on a cutting head (8). The cutting head (8) can be displaced by means of a drive in at least two axes. The cutting-to-size of mats requires a vertical cutting angle (B-B) and an inclined cutting angle (C-C) in order to provide the mat cutout with the, in the main, usual bevel cut. In order to adjust the blade (21) from the first cutting angle (B-B) into the second cutting angle (C-C) or vice versa, the cutting head (8) is run up against a stop (17) arranged on the cutting machine and is brought into contact in such a way that a swivellable element (20) carrying the blade (21) is swivelled from one into the other cutting angle (B-B, C-C). This adjustment can thus take place in an automatically controlled manner, without an additional drive being required for this.

25 Claims, 4 Drawing Sheets

CUTTING MACHINE FOR CUTTING MATS

The present invention relates to a cutting machine with at least one cutting head, which can be displaced in at least two axes. The invention further relates to the operation of this cutting machine.

Various, automatically operating cutting machines are known particularly for cutting mats to size, i.e. frames for the accommodation of pictures, documents or suchlike. Mats are usually made of cardboard. An opening has to be cut out of the latter, through which the given picture can be seen. In some cases, however, mats with a plurality of such cutouts are desired.

A common feature of comparable cutting machines is the fact that the mat blank fixed on a base plate can be cut by means of at least one cutting head displaceable in two axes over this mat blank. The blade must be positioned inclined in order to provide the opening with the, in the main, usual bevel cut in mats, for example at an angle of 45 degree. The notches serving as decoration can thus also be made, i.e. incisions with a v-shaped cross-section. However, in order to provide a cut orientated at right angles to the surface of the mat, a blade orientated at an angle of 90 degree to the base plate of the cutting machine is required. The vertical cut is required primarily for cutting the mat to size at the outside. In addition, however, the cutting-to-size of packages for the transport or dispatch of framed pictures is also possible.

In order to be able to provide both a bevel cut and a vertical cut, the applicant successfully offers an automatic cutting machine with two different cutting heads. This makes for very convenient use by the user. However, two separate cutting heads have to be produced, mounted and guided, and if need be controlled.

A simpler variant consists in designing the cutting heads so as to be interchangeable or at least in providing an interchangeable blade insert. Such a solution is described for example in publication WO 2008/004253. For the replacement of the cutting heads or blade inserts, however, it is necessary to intervene manually in the cutting process, as a result of which the cutting machine has in any case to be stopped. This is of course an inconvenience and is under no circumstances in line with an automated operational procedure.

The present invention therefore set itself the task of providing a cutting machine, which on the one hand also enables an automatic operation at different cutting angles and on the other hand can be offered as a more favourable option to the previous comparable cutting machines.

The cutting machine according to the invention corresponds to the characterising features of claim 1. The method for its operation proceeds from claim 25. Further advantageous developments of the inventive idea can be seen in the dependent claims.

The invention enables, if it should be desired, a manually operable cutting-angle adjustment without a blade replacement. In particular, however, an automatic adjustment of the cutting angle of the blade taking place by means of a drive and controllable by means of a controller is enabled, without an additional drive being required for this. On the contrary, use may be made of the drive which is in any case present on automatically operating cutting machines for the displacement of the cutting head in at least an X- and Y-axis. This saves both on costs as well as complicated design measures. In a development of the invention, a height adjustment of the blade is also made possible with the aid of an existing drive.

Preferred examples of embodiment of the invention are described in greater detail below with the aid of the drawing.

Figure 1:
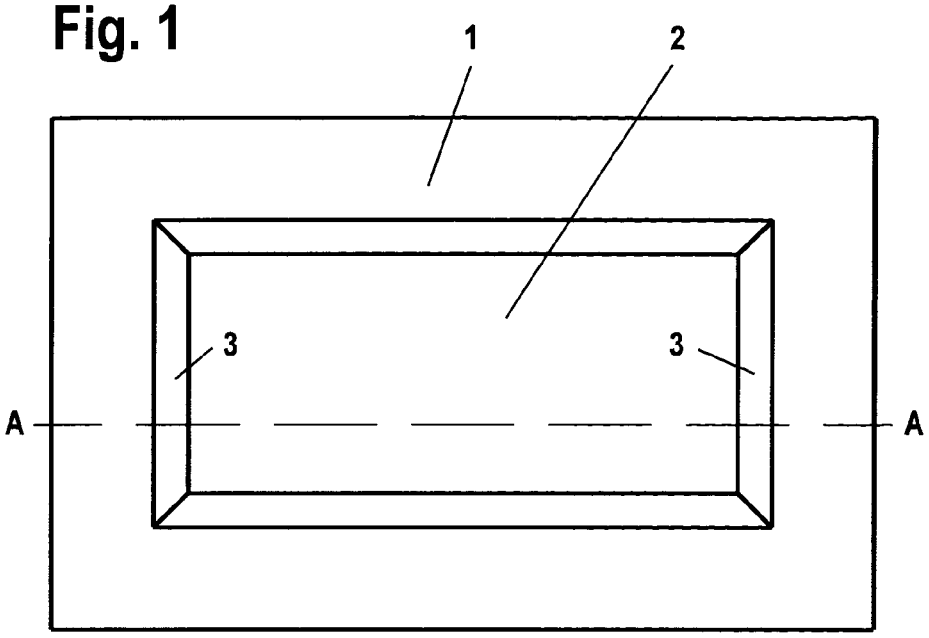
FIG. 1 shows a view of a mat.
Figure 2:
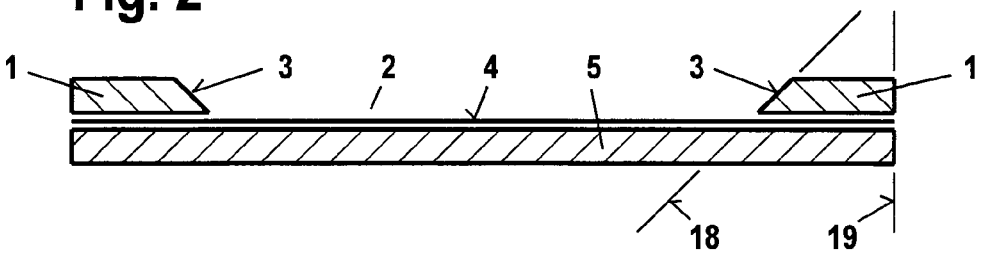
FIG. 2 shows a cross-section through line A-A in FIG. 1.

A mat 1 can be seen from FIGS. 1 and 2, i.e. a frame with a window-like cutout 2 with bevelled cut edges 3. Picture 4 or also another object to be framed and, as the case may be, a rear panel 5 are arranged behind, or under, mat 1. The whole assembly is usually fixed behind a glass pane in a picture frame.

Figure 3:
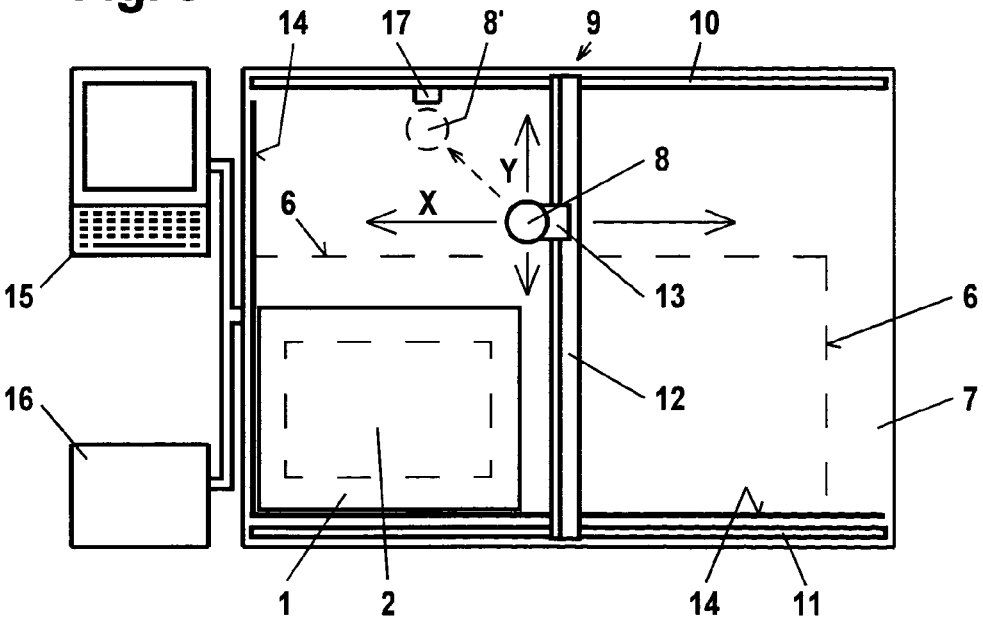
FIG. 3 shows a schematic view of a cutting machine.

According to FIG. 3, blank 6 to be cut is arranged on support 7 of the cutting machine. A cutting head 8 is displaceable for cutting mat 1 in a longitudinal axis X and a transverse axis Y. For this purpose, a device 9 is provided, which in the present example comprises two rails 10 and 11, which each run parallel to an opposite edge of support 7. A beam 12 can be displaced on these rails 10 and 11. Said beam carries cutting head 8 or a displaceable guide carriage 13 holding the latter. Support 7 comprises at least one abutting edge 14 and/or a device for holding blank 6 fast. Furthermore, a controller 15 (only indicated) and at least one drive 16 are provided. The latter is to be understood here only symbolically, since it can be constituted in an arbitrary manner, ranging from a pneumatic drive to an arrangement of electric motors. The latter can of course be disposed on the components to be driven. If the preferred, automatic adjustability of the cutting angle is desired, at least one stop 17 is also provided. Its precise function will be dealt with later. In FIGS. 1 and 2, the front side of mat 1 lies facing upwards. Blank 6, however, is preferably cut from its rear side. In this way, any damage or scratch marks on the subsequently visible front side of mat 1, which could arise during the holding-fast and cutting, can be avoided. In any event, an inclined blade setting 18 for the cutting-out of cutout 2 and a vertical blade setting 19 for the external cutting-to-size are required.

Figure 4:
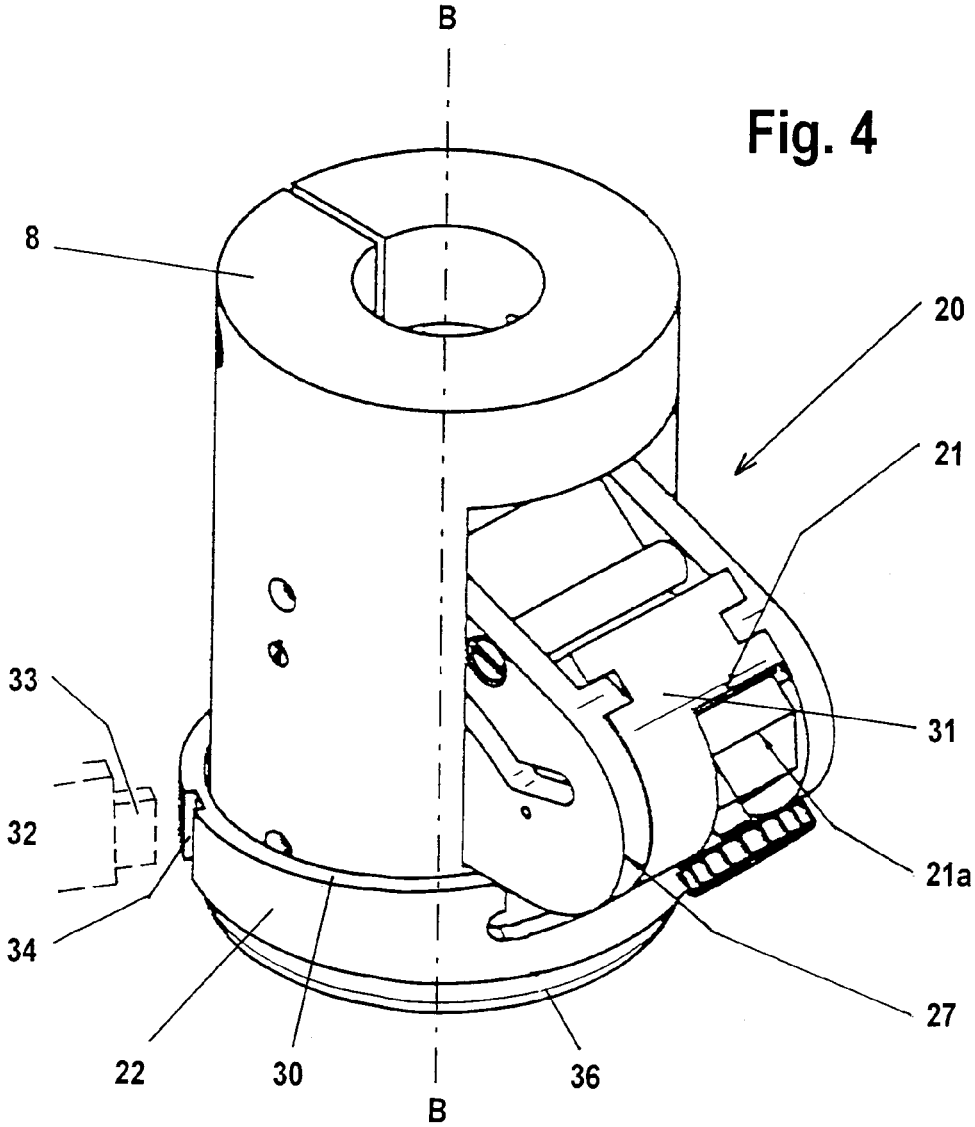
FIGS. 4-5 show views of a cutting head.
Figure 5:
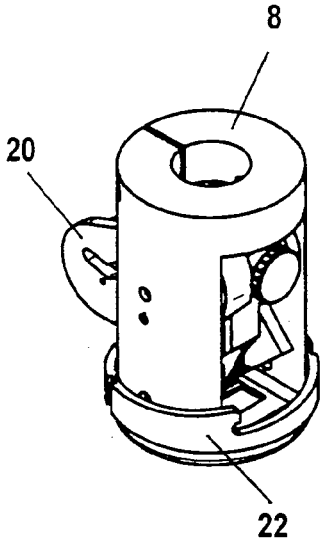
Figure 6:
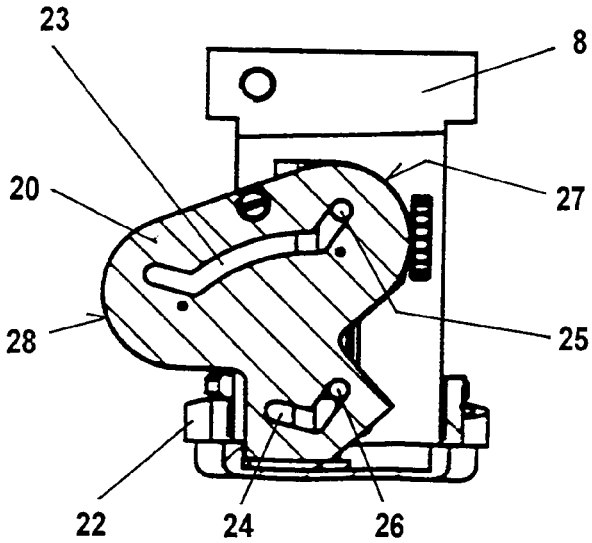
FIG. 6 shows a cross-section through the cutting head according to FIG. 5.
Figure 7:
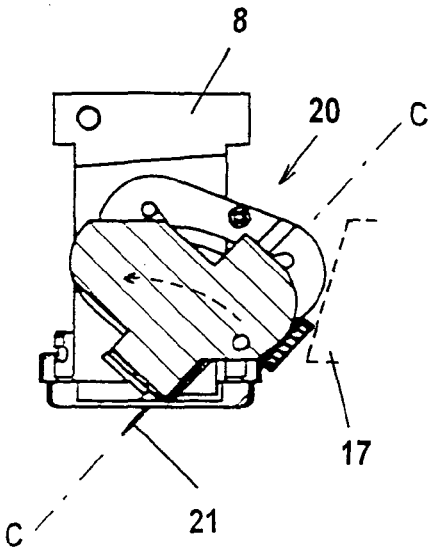
FIG. 7 shows the cutting head with an inclined cutting angle.
Figure 8:
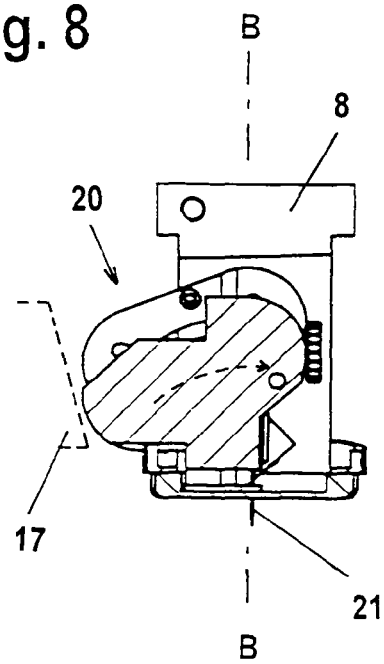
FIG. 8 shows the cutting head with a vertical cutting angle.
Figure 9:
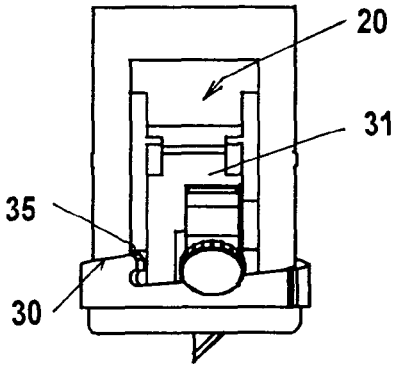
FIGS. 9-10 show the cutting head according to FIGS. 7 and 8, in each case from the direction of a stop.
Figure 10:
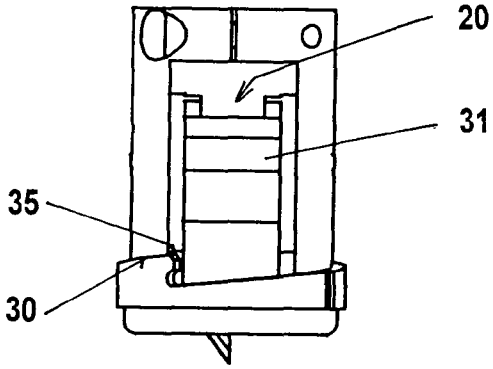
Figure 11:
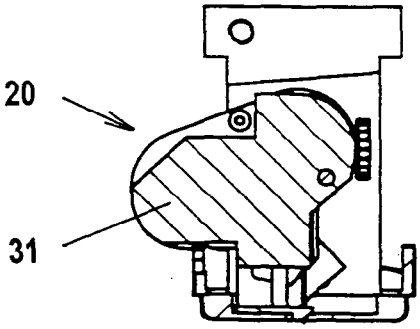
FIG. 11 shows the cutting head with a raised blade.
Figure 12:
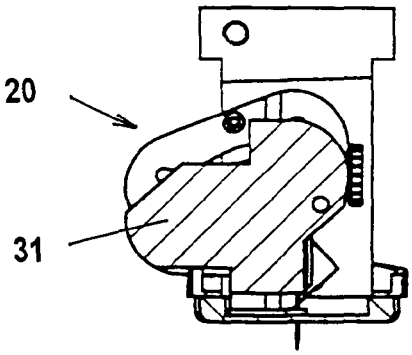
FIG. 12 shows the cutting head with a lowered blade.
Figure 16:
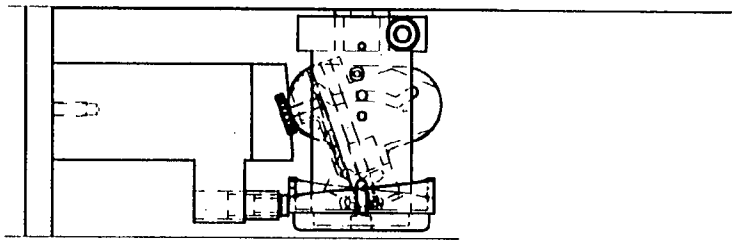
FIGS. 13-19 show the sequence of movements of the blade from the inclined into the vertical cutting angle.
Figure 17:
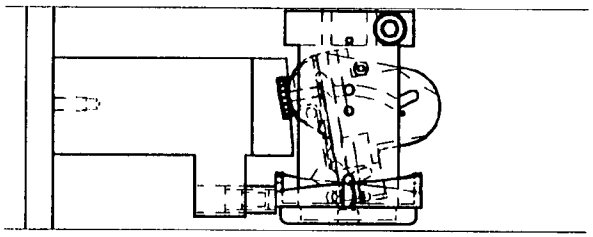
Figure 18:
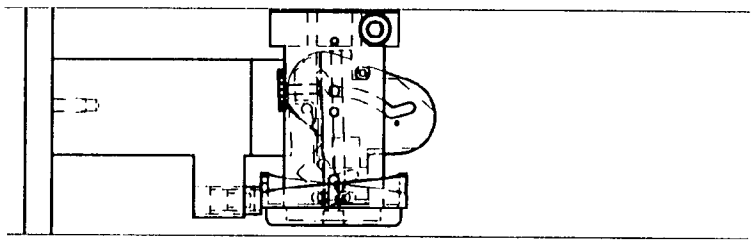
Figure 19:
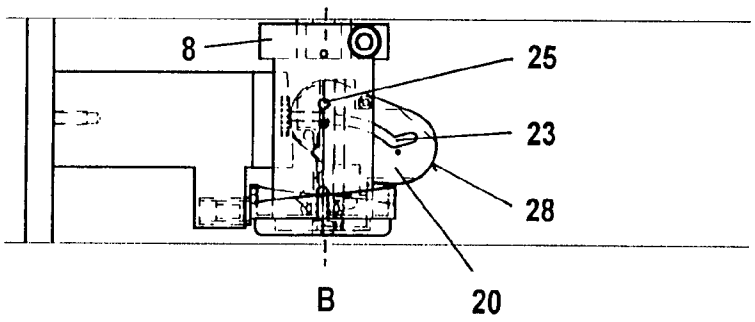
Figure 15:
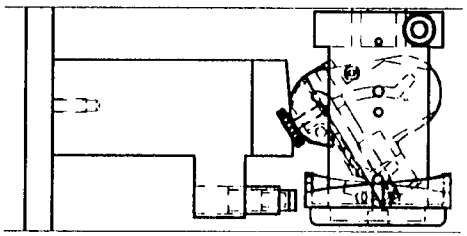
Figure 14:
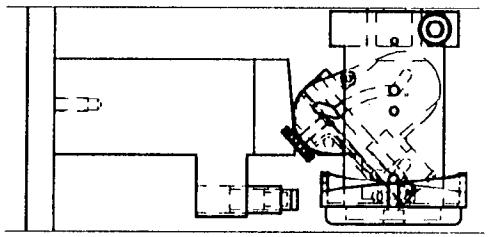

According to FIG. 4, cutting head 8 comprises a swivellable element 20. A blade 21 or a blade insert 21*a* is arranged in the latter. The blade tip, which cannot be seen in FIG. 4, is pointing downwards. It is guided in such a way that it projects at the bottom out of cutting head 8 or out of a base at least during the cutting. The base is constituted here as a rotation element 22. The latter and cutting head 8 are mounted so as to be rotatable with respect to one another about a vertical axis B-B. Rotation element 22 is displaced over blank 6. In FIG. 4, swivellable element 20 is represented in a position in which blade 21 stands inclined, i.e. at an inclined cutting angle diverging from the vertical. The vertical cutting angle corresponds to axis B-B or it lies parallel thereto. In the position according to FIG. 5, blade 21 stands vertical. The corresponding positions can also be seen from FIGS. 7 and 8. In FIG. 7, the inclined blade position is also characterised, for the sake of a better understanding, as an axis, i.e. as inclined cutting angle C-C. In the present connection, the vertical and the inclination are always to be understood in relation to the plane of mat 1, or of blank 6 arranged on support 7 of the cutting machine. In the represented example of embodiment, swivellable element 20 is guided in at least one connecting link 23 and 24, for example by means of at least one pin 25 and 26, see FIG. 6. This guidance arrangement is advisedly provided on both sides of swivellable element 20. It should also be added that the pins and connecting links can of course also be arranged the other way round on the respective other component. The pivotal point or point of intersection of cutting angles B-B and C-C is located at the bottom on cutting head 8, in the region of the base or rotation element 22 or even below the latter. Hence the part-circle-shaped guidance arrangement constituted here as connecting link 23. Lower connecting link 24 lying closer to the pivotal point can be v-shaped. Swivellable element 20 comprises a guide stop 27 and 28, one on each of two opposite sides. It is however also not ruled out to provide only one guide stop or also more than two guide stops. Guide stops 27 and 28 are curved outwards, i.e. constituted arched outwards.

In order to bring the blade position from inclined cutting angle C-C into vertical cutting angle B-B, i.e. related to mat 1 according to FIG. 2 from blade setting 18 to blade setting 19, cutting head 8 is displaced by controller 15 towards stop 17. In the schematic representation according to FIG. 3, this corresponds to position 8' of cutting head 8 indicated by a dashed line. It should be added here that the position of stop 17 is to be understood solely by way of example; it could also be positioned elsewhere, for example at the left-hand edge of support 7, as long as it can be run into by cutting head 8. In the represented embodiment, stop 17 is constituted such that beam 12 can be moved away over the latter unhindered. A plurality of differently arranged stops 17 is also expressly not ruled out, for example one in each case on the lengthwise and on the narrow side of support 7. An example of embodiment of a stop 17 is represented in FIGS. 13-19. In this preferred embodiment, stop 17 comprises an inclined face 29, i.e. diverging from the vertical, said face projecting farther at the bottom towards cutting head 8, or guide stop 27, than at the top. A vertical or differently formed face 29 is however also possible.

Figure 13:
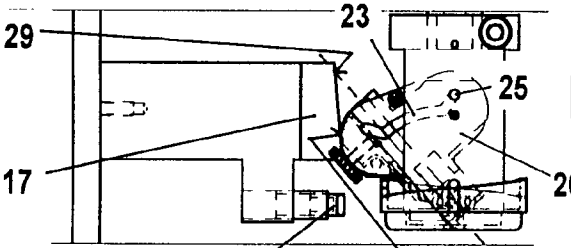

In the position with inclined cutting angle C-C according to FIG. 13, pin 25 is located in the right-hand, upwardly bent first end of connecting link 23. Swivellable element 20 thus hangs secured in this first position. When cutting head 8 is advanced closer to stop 17, the interaction of inclined surface 29 of stop 17 on the one hand and curved, or outwardly arched, guide stop 27 on the other hand pushes element 20 upwards out of the arresting element and swivels it successively from its first position corresponding to cutting angle C-C into the second position with vertical cutting angle B-B. The corresponding sequence of movements can clearly be seen from further FIGS. 14-19. It should be added here that a component other than guide stops 27 and 28 represented here could also perform their function, as long as it is suitably arranged and constituted, for example a carriage 31, the function whereof will be dealt with later. In the vertical cutting angle, pin 25 is located in the opposite, also upwardly bent second end of connecting link 23. Swivellable element 20 again thus hangs securely in this second position. A reliable and precise cutting capability is possible in both positions.

In order to readjust inclined cutting angle C-C, the cutting head can be rotated through 180°, so that opposite guide stop 28 of swivellable element 20 abuts against stop 17. Swivellable element 20 is thus raised and swivelled in the opposite direction out of the locking element. The sequence of movements also corresponds to the representation in FIGS. 13-19.

A height adjustment of blade 21 is also possible. This can be used to insert and withdraw blade 21 in order to adapt the cutting depth to the thickness of respective blank 6 or, for example, to produce non-penetrating notches in blank 6.

This height adjustment could theoretically take place manually. The automatic adjustment described below is however preferred. In the present example of embodiment, the height adjustment takes place with the aid of rotation element 22. In this regard, note should be taken of FIGS. 4-12. Rotation element 22 mounted rotatably with respect to cutting head 8 has a different height in these drawings. The purpose is to form an inclined, or ascending, guide path 30 for a component lying thereon. This component can either be cutting head 8 itself, swivellable element 20 or a carriage 31 carrying the latter or arranged on the latter. As an alternative to the preferred embodiment previously described, it would also be conceivable to provide rotation element 22 with a thread acting as an inclined guide path.

The decisive factor is that the concerned component 8, 20 or 31 is in an operative connection with blade 21 and the rotational position of rotation element 22 with respect to the given component acts on the height position of this component and thus of blade 21. It should further be noted that cutting head 8 usually has a drive in any case, in order to cause it to rotate about axis B-B. This is necessary in order to be able to orientate blade 21 both in the cutting direction lying lengthwise with respect to the mat and also in the cutting direction lying transversely thereto. In a standard, rectangular mat the cutting directions correspond to longitudinal axis X and transverse axis Y of the cutting machine. Other arbitrary geometrical shapes of mat 1 and/or its cutout 2 are also possible.

In order to bring about the rotation required for the height adjustment, rotation element 22 must be held fast. For this purpose, a locking element 32 is provided, corresponding to stop 17, see FIGS. 4 and 13-19. Said locking element can comprise at least one latching nose 33, which is intended to engage in at least one latching stop 34 of rotation element 22. Latching stop 34 is constituted here as a groove. The stationary part of locking element 32 is advisedly arranged in the region of stop 17, as emerges from FIG. 13. Latching nose 33 projects beneath stop 17 in the direction of cutting head 8.

In the embodiment represented in FIGS. 4-12, cutting head 8 rests in rotation element 22. In order to convert the rotary motion into a lifting motion, a guide element 35 can be provided on cutting head 8, swivellable element 20 or on carriage 31, see FIGS. 9 and 10, which is supported on guide path 30. Guide element 35 can also be constituted and arranged in a manner other than is represented here. Blade 21 is raised in the position according to FIG. 11 and lowered in the position according to FIG. 12. Higher and lower blade positions are however also possible.

Within the scope of the claims, the proposed cutting machine can be constituted in a way other than that represented and described. This relates in particular to the precise design of the individual components and their guidance. It is not ruled out to move cutting head 8 by means of an arm instead of by means of a rail/beam system. At its underside according to FIG. 4, cutting head 8 can also comprise a slide element 36, for example made of plastic.

The invention claimed is:

1. A cutting machine with at least one cutting head (8), which is displaceable in at least two axes (X, Y), characterised by at least one blade (21) mounted with respect to the cutting head (8) in a swivelling manner relative to a cutting angle (B-B, C-C), wherein this blade (21) is orientated, in at least one swivelling position, at an inclined cutting angle (C-C) to a support (7) accommodating the object to be cut, with the purpose of being able to perform a bevel cut, and wherein said cutting machine also comprises at least one stop (17), with which the cutting head (8) can be brought into contact in such a way that the swivelling position of the blade (21) can be moved by the stop (17) from the cutting angle (B-B) into the inclined cutting angle (C-C) and/or vice versa.

2. The cutting machine according to claim 1, characterised in that the blade (21) or a blade insert (21*a*) carrying the latter is arranged on a swivellable element (20) mounted on the cutting head (8).

3. The cutting machine according to claim 2, characterised in that the swivellable element (20) comprises at least one guide stop (27, 28, 31), which can be brought into contact with the stop (17).

4. The cutting machine according to claim 3, characterised in that the swivellable element (20) comprises two guide stops (27, 28, 31) arranged lying opposite one another and directed outwards.

5. The cutting machine according to claim 4, characterised in that the guide stops (27, 28, 31) are curved outwards or arched outwards.

6. The cutting machine according to claim 5, characterised in that the stop (17) comprises an inclined face (29), which at the bottom projects farther towards the cutting head (8) than at the top.

7. The cutting machine according to claim 6, characterised in that the swivellable element (20) is arranged on at least one part-circle-shaped guidance arrangement and that the pivotal point or point of intersection of the cutting angles (B-B, C-C) is located either at the bottom on the cutting head (8) or beneath the at least one part-circle-shaped guidance arrangement.

8. The cutting machine according to claim 7, characterised in that the guidance arrangement of the swivellable element (20) comprises at least one connecting link (23) and at least one pin (25) guided in the at least one connecting link.

9. The cutting machine according to claim 8, characterised in that the connecting link (23) comprises at its ends at least one shaped portion serving to arrest the pin (25) in an end position.

10. The cutting machine according to claim 9, characterised in that the connecting link (23) is bent upwards at its ends, as a result of which the swivellable element (20) hangs secured in this end position.

11. The cutting machine according to claim 10, characterised by at least a second v-shaped connecting link (24), in which a pin (26) is guided.

12. The cutting machine according to claim 1, characterised by at least one rotation element (22) mounted rotatably with respect to the cutting head (8) and serving for the height adjustment of the blade (21).

13. The cutting machine according to claim 12, characterised in that the rotation element (22) is arranged at the lower end of the cutting head (8).

14. The cutting machine according to claim 12, characterised in that the rotation element (22) has a differing height.

15. The cutting machine according to claim 14, characterised in that the rotation element (22) forms an ascending guide path (30) for a component (8, 20, 31) lying thereon, which is in an operative connection with the blade (21), wherein the rotational position of the rotation element (22) acts on the height position of this component (8, 20, 31) and therefore of the blade (21).

16. The cutting machine according to claim 15, characterised in that the component lying on the guide path (30) is either firstly the cutting head (8) itself or secondly the swivellable element (20) or thirdly a carriage (31) carrying the latter or arranged on the latter.

17. The cutting machine according to claim 16, characterised by at least one guide element (35), which is arranged or formed on the respective component (8, 20, 31) and which is supported on the guide path (30).

18. The cutting machine according to claim 12, characterised in that the rotation element (22) comprises a thread.

19. The cutting machine according to claim 12, characterised by at least one locking element (32), by means of which the rotation element (22) rotatable with respect to the cutting head (8) can be prevented from rotating.

20. The cutting machine according to claim 19, characterised in that the locking element (32) comprises at least one latching nose (33) and at least one latching stop (34), which for example is constituted as a groove.

21. The cutting machine according to claim 20, characterised in that, in each case, one of the two components latching nose (33) and latching stop (34) is arranged either on the rotation element (22) or at a point outside the cutting head (8).

22. The cutting machine according to claim 21, characterised in that either the latching nose (33) or the latching stop (34) is arranged in the region of the stop (17).

23. The cutting machine according to claim 22, characterised in that either the latching nose (33) or the latching stop (34) is arranged beneath the stop (17).

24. A method for the operation of a cutting machine with at least one cutting head (8), which is displaceable in at least two axes (X, Y) and with at least one blade (21) mounted with respect to the cutting head (8) in a swivelling manner relative to a cutting angle (B-B, C-C), wherein this blade (21) is orientated, in at least one swivelling position, at an inclined cutting angle (C-C) to a support (7) accommodating the object to be cut, with the purpose of being able to perform a bevel cut, characterised in that, for the purpose of adjusting a swivelling position of the at least one blade (21) from the cutting angle (B-B) into the inclined cutting angle (C-C) and/or vice versa, the at least one cutting head (8) carrying the blade (21) and displaceable in at least two axes (X, Y) is run up against a stop (17) arranged on the cutting machine and is brought into contact in such a way that the blade (21) or a swivellable element (20) carrying the latter is swivelled from one into the other cutting angle (B-B, C-C).

25. The method according to claim 24, characterised in that, for the purpose of adjusting the height position of the blade (21), a rotation element (22) mounted rotatably with respect to the cutting head (8) or with respect to a component (20, 31) arranged on the latter is used, wherein the cutting head (22) or the respective component (20, 31) is rotated by means of a drive and the rotation element (22) is held fast by means of a locking element (32), as a result of which the mutual position of the cutting head (8) and the rotation element (22) is changed, on account of an inclined guide path (30), in such a way that the height position of the blade (21) is adjusted.

* * * * *